United States Patent [19]

Leroux

[11] 4,120,066

[45] Oct. 17, 1978

[54] EXPANSION JOINT FOR ROADWAY SECTIONS

[76] Inventor: Yves Gerald Leroux, 8790 Terrasse Forget, La Salle, Quebec, Canada

[21] Appl. No.: 802,497

[22] Filed: Jun. 1, 1977

[51] Int. Cl.[2] ..... E01D 19/06

[52] U.S. Cl. ..... 14/16.5; 404/69; 52/396

[58] Field of Search ..... 404/69, 68, 47; 14/16.5; 52/396

[56] References Cited

U.S. PATENT DOCUMENTS

| | | | |
|---|---|---|---|
| 3,482,492 | 12/1969 | Bowman | 14/16.5 X |
| 3,603,055 | 9/1971 | Dale | 404/65 X |
| 3,788,758 | 1/1974 | Scheffel | 404/56 |
| 3,797,952 | 3/1974 | Pommerening | 14/16.5 X |
| 3,830,583 | 8/1974 | Becht | 404/69 |
| 3,880,540 | 4/1975 | Rizza | 404/69 |
| 3,904,302 | 9/1975 | Bertschmann | 404/68 |
| 3,904,304 | 9/1975 | Honegger | 404/69 |
| 3,907,443 | 9/1975 | McLean | 404/56 |
| 4,030,156 | 6/1977 | Raymond | 14/16.5 |

*Primary Examiner*—Nile C. Byers
*Attorney, Agent, or Firm*—Hirons & Rogers

[57] ABSTRACT

An expansion joint for mounting in the gap left between roadway sections, e.g. sections of a roadway bridge structure, to accommodate thermal expansion of the sections, is provided with at least one intermediate beam member extending in the gap across the width of the roadway and sealing strips of elastomeric material fitted between the roadway section edge structures and the intermediate beam. The joint has a plurality of units spaced apart across the width of the roadway, each unit comprising a lazy tong link arrangement pivotally mounted to the edge structures of the two roadway sections and to the intermediate beam members and extending across the gap, so as to ensure that any expansion or contraction of the gap between the roadway sections is equally distributed among the various parts of the gap on each side of and between the intermediate beam or beams. A spanning member is provided in each joint unit, which extends across the gap below the intermediate beam members and is slidable with respect to them and with respect to the roadway sections. The lazy tongs link arrangement and the spanning member are both pivotable to a small degree with respect to each of the roadway sections, so as to accommodate relative height changes between them without damage to the structural parts.

18 Claims, 9 Drawing Figures

EXPANSION JOINT FOR ROADWAY SECTIONS

FIELD OF THE INVENTION

This invention relates to joints for roadway sections such as bridges, carriage-ways or the like, and more particularly to expansion joints which are to fit into and seal the gap between adjacent roadway sections, and maintain the seal as the gap expands and contracts due to thermal expansion and contraction of the roadway sections.

BACKGROUND OF THE INVENTION

It is commonplace to use a resilient sealing strip such as rubber, inserted into the gap between a roadway sections of a carriage-way, bridge etc. to close and seal the gap. Structural and retaining members are included at the edges of the gap to maintain the sealing strip in position, and allow for its necessary tension to effect its sealing function. It is, however, often desirable to use two or three of such sealing strips arranged side by side to seal the gap between the roadway sections, with an intermediate retaining structural member between the seals, since a relatively large gap may be necessary to allow for expansion, particularly on bridges, and sealing strips of large width are difficult to handle and install, and do not perform satisfactorily in use.

Many highway authorities demand that expansion joints, particularly for use between roadway sections of bridges, effect a watertight seal of the joint at all times. The authorities seek to ensure that there is no risk of contamination of rivers, terrain etc. below the bridge by liquids or the like dropping from the bridge roadway. A particular hazard in this respect is road salt, which may be applied to remove ice from the bridge roadway sections.

BRIEF DESCRIPTION OF THE PRIOR ART

Many prior proposals have been made and described in the literature for provision of expansion joints for use between roadway sections.

For example U.S. Pat. No. 3,854,835 Stog shows a form of joint which includes a sealing strip of rubber which is tensioned in the gap between the roadway sections by the provision of tensioning bolts associated with the respective roadway sections. U.S. Pat. No. 3,850,539 Bowman et al. shows a joint in which longitudinal edges of a resilient sealing strip are thickened and embedded in roadway section structures, the sealing strip having an M-shaped or inverted V-shaped cross-section to facilitate its expansion and contraction. U.S. Pat. No. 3,570,378 Honegger shows a form of joint having a gable shaped resilient sealing strip releasably mounted in the structure defining the gap, and releasable from the top. In these patents, only a single sealing strip is used to fill the width of the gap, so that means for equalizing the tension on compression of two such strips are not necessary. The same applies to the joints shown in U.S. Pat. No. 3,605,586 Bowman and U.S. Pat. No. 2,321,873 Tate.

U.S. Pat. No. 3,606,826 Bowman shows an expansion joint which includes at least in one embodiment an intermediate beam member extending across the width of the gap, with a resilient sealing strip on either side, to fill the two smaller gaps so formed. The intermediate member is supported on a slidable bearing beam. However, no particular means is employed to ensure correct movement of the intermediate beam to maintain it centrally in the gap, other than the resilience of the sealing strips themselves.

Canadian Pat. No. 862,451 Bowman shows a form of expansion joint which has one embodiment similar to that of U.S. Pat. No. 3,606,826 Bowman, and another embodiment having a central box spacer extending lengthwise across the gap and secured to a lower slidable support beam extending between the two roadway sections across the gap. Pivotal links extend between the box spacer and slots in the roadway section structures which are supposed to maintain the box spacer centrally in the gap. However, this mechanism relies on the resilient urging of the seals to fulfill its function.

U.S. Pat. No. 3,797,188 Mansfeld shows a form of expansion joint in which an intermediate beam member is provided, which protrudes into a formation of the sealing strip, but does not divide it into two separate parts. U.S. Pat. No. 3,626,822 Koster shows another joint having an intermediate beam member, referred to as a "gripping means", with a sealing strip on either side, but there is no provision for mounting the intermediate beam member centrally in the gap, when a roadway section expands or contracts. Various different forms of sealing elements for roadway expansion joints are shown in U.S. Pat. No. 3,455,215 Webb, Canadian Pat. No. 831,754 Crone, Canadian Pat. No. 913,958 Berchou et al., Canadian Pat. No. 920,856 Berchou and Canadian Pat. No. 922,137 Bowman, among others.

U.S. Pat. No. 3,648,423 Cole shows expansion joint for structural panels such as wallboards, provided with a covering strip. A lazy tongs linkage arrangement connected between the panels and the covering strip maintains the covering strip over the center of the gap. However, this is not a load bearing structure of the type encountered in roadways and bridges, and does not include resilient sealing strips.

BRIEF SUMMARY OF THE INVENTION

It is an object of the present invention to provide an improved expansion joint for use between roadway sections.

It is a further object to provide a novel expansion joint for use between roadway sections in which at least one intermediate structural member is used expanding the length of the joint, in the gap between the roadway sections, and means are provided for distributing the amount of expansion or contraction of the gap between the roadway sections, substantially equally between the various sections of the gap.

It is a further object of the present invention to provide an expansion joint for roadway sections which will accommodate small changes in relative vertical height between the roadway sections, without substantially damaging the expansion joint mechanism.

According to the present invention, there is provided an expansion joint for adjacent first and second roadway sections having a gap therebetween to allow expansion of said sections, the joint comprising:

at least one intermediate beam member in said gap and extending along at least a substantial portion of the width of the roadway sections;

resilient sealing means located in and closing gaps between said intermediate beam member and the roadway sections, substantially to seal the roadway surface across the gap;

a plurality of joint units in spaced apart relationship across the width of the roadway sections, each said joint unit extending from the first roadway section to the second roadway section across the gap, and including means for substantially maintaining a predetermined ratio of distance between the first roadway section edge and the intermediate beam member, to that between the second roadway section edge and the intermediate beam member, when the size of the gap between the first and second roadway sections changes, said means comprising:

a sectionally expandable and contractable device secured to the first roadway section, the intermediate beam member and the second roadway section, said device having expandable and contractable sections between said securings which expand and contract in the direction across the gap, the expansion and contraction of one of said device sections causing corresponding expansion or contraction of the others of said device sections, in predetermined relationship thereto, so as to move the intermediate beam member transversely across said gap in response to movement of the first roadway section or second roadway section to vary the size of the gap.

Thus, in the expansion joint according to the invention, a means is provided whereby, on expansion or contraction of one or both of the roadway sections causing a change in the size of the gap between them, the change in gap size is accommodated by both or all of the sealing strips, rather than by only one of them. This is achieved, according to the invention, by providing a connection between the roadway sections and the or each intermediate structural member through which the intermediate structural member can move transversely of the roadway sections and the gap therebetween, in response to the movements of the roadway sections, to a predetermined extent to cause compression or relaxation of each sealing strip to accommodate the change in size of the gap. In a preferred embodiment according to the invention, this arrangement is a lazy tongs link arrangement. Such an arrangement causes positive movement of the structural intermediate member or members in response to the movement of a roadway section, and does not rely on resilient forces exerted by the sealing strips for this movement. The sealing strips do not therefore have to be arranged in any special way so as to exert a particular force on the intermediate beam member, and can operate under desirable tension-free and compression-free conditions. In this manner, the risk of displacement of one of the sealing strips, with the effect of unsealing the joint, is materially reduced.

DESCRIPTION OF THE PREFERRED EMBODIMENTS

In the preferred form of the invention, the sectionally expandable and contractable device comprises a lazy tongs link arrangement pivotally secured to the first roadway section, pivotally secured to the second roadway section and pivotally secured to the intermediate beam member. Such an arrangement is adapted to move the intermediate beam member transversely of the roadway sections in response to movement of the first or second roadway sections. This is the simplest and most economical form of sectionally expandable and contractable device for use in the present invention, although other alternatives such as telescopic, pneumatic or hydraulic arrangements can be used if desired.

Preferably the expansion joint according to the invention has joint units substantially equally spaced across the width of the roadway sections in the gap, the joint units including at least one spanning member extending between the first roadway section and the second roadway section and movable relative to the roadway sections, the spanning member being rigidly affixed to the intermediate beam member. The joint can have any number up to about 12 of intermediate beams, extending lengthwise of the joint within the gap, thereby dividing the gap into up to about 13 width sections. Preferably, all of these width sections are of approximately the same width. Each one contains a sealing strip, so as to substantially seal the roadway expansion joint against penetration by liquids from the roadway surface to the terrain below.

The joint units of the expansion joint of the present invention are preferably provided with end boxes, which extend into the adjacent roadway sections, the spanning member being received in said end boxes in sliding relation. The spanning member also preferably passes through glider boxes mounted to the underside of intermediate beam members, in sliding arrangement thereto. In such an arrangement, the glider box can be pivotally secured to an intermediate section of the lazy tongs link arrangement, so that, when the width of the gap changes, the glider box and hence the intermediate beam secured thereto moves in response to the lazy tongs arrangement movement and slides with respect to the spanning member.

In another preferred form of the present invention, the spanning member is received in end boxes set into the roadway sections, and the lazy tongs link arrangement is mounted thereto, for limited angular movement relative to the end boxes, in a vertical plane. By such an arrangement, change in relative vertical position of the two roadway sections, for instance as a result of the settling or sinking of a support pillion supporting one of the roadway sections, can be accommodated without damaging the joint unit as a result of such relative vertical movement.

The preferred form of joint according to the present invention provides access to many if not all of its structural parts from the top of the roadway sections, so that parts can be removed and replaced simply and conveniently after installation of the joint, without requiring its total dismantling. Such an arrangement provides for economical surfacing and repair of the joint after extensive service.

BRIEF REFERENCE TO THE DRAWINGS

DETAILED DESCRIPTION OF THE SPECIFIC PREFERRED EMBODIMENT

Figure 1:
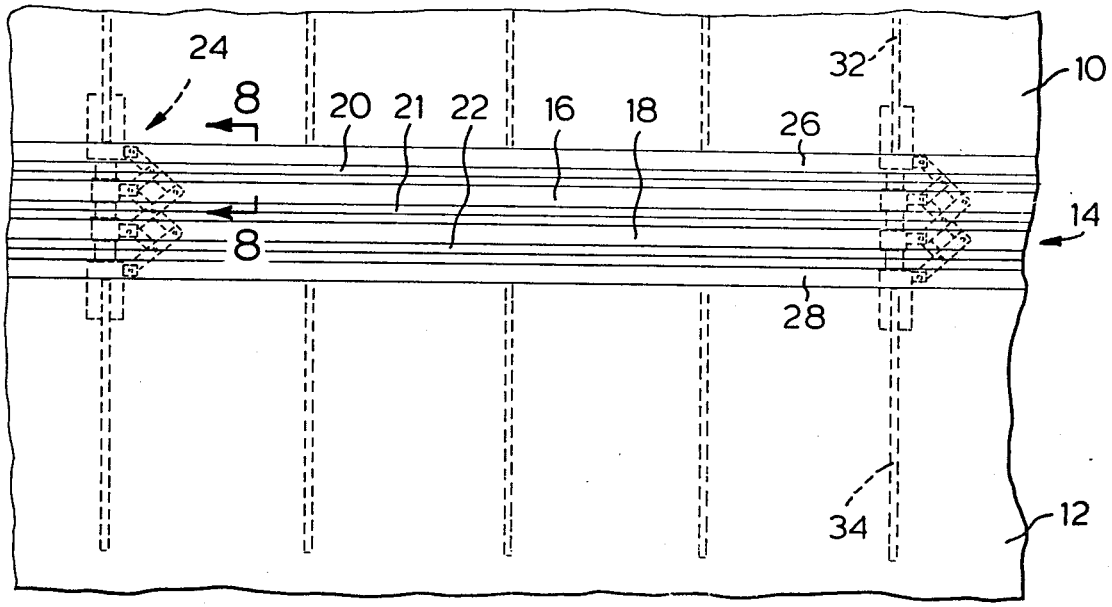
FIG. 1 is a diagrammatic plan view, partly in section, of a portion of a roadway section embodying an expansion joint in accordance with the present invention.

In the drawings, like reference numerals indicate like parts.

With respect to FIG. 1, there is indicated a first concrete roadway section 10, e.g. of a bridge, and a second concrete roadway section 12 having a gap 14 between their adjacent edges, the gap extending the full width of the roadway. The gap 14 is provided to accommodate expansion and contraction of the roadway sections 10, 12 due to thermal factors, causing consequent contraction and expansion of the width of the gap 14. To permit such contraction and expansion of the gap 14 and at the same time maintain a substantially watertight seal of gap 14, as required by many highway authorities, an expansion joint according to the present invention is provided, comprising a number, e.g. 2 of intermediate beams generally indicated 16, 18, extending the full width of the roadway, parallel to one another and to the roadway section edges and dividing the gap 14 into substantially equal longitudinal portions. Compressible sealing strips 20, 21, 22 are provided to fill the gaps between the intermediate beams 16, 18. At intervals of about 3 feet along the length of the gap 14, individual joint units such as 24 are provided, secured to edge structures of the roadway sections 10, 12, and connected to the intermediate beams 16, 18 so as to retain the intermediate beams 16, 18 in position to keep the gaps 14 divided into substantially equal width longitudinally extending portions, and retain watertightness of the joint. The structure and operation of individual joint units 24 are illustrated in FIGS. 2–9.

Figure 2:
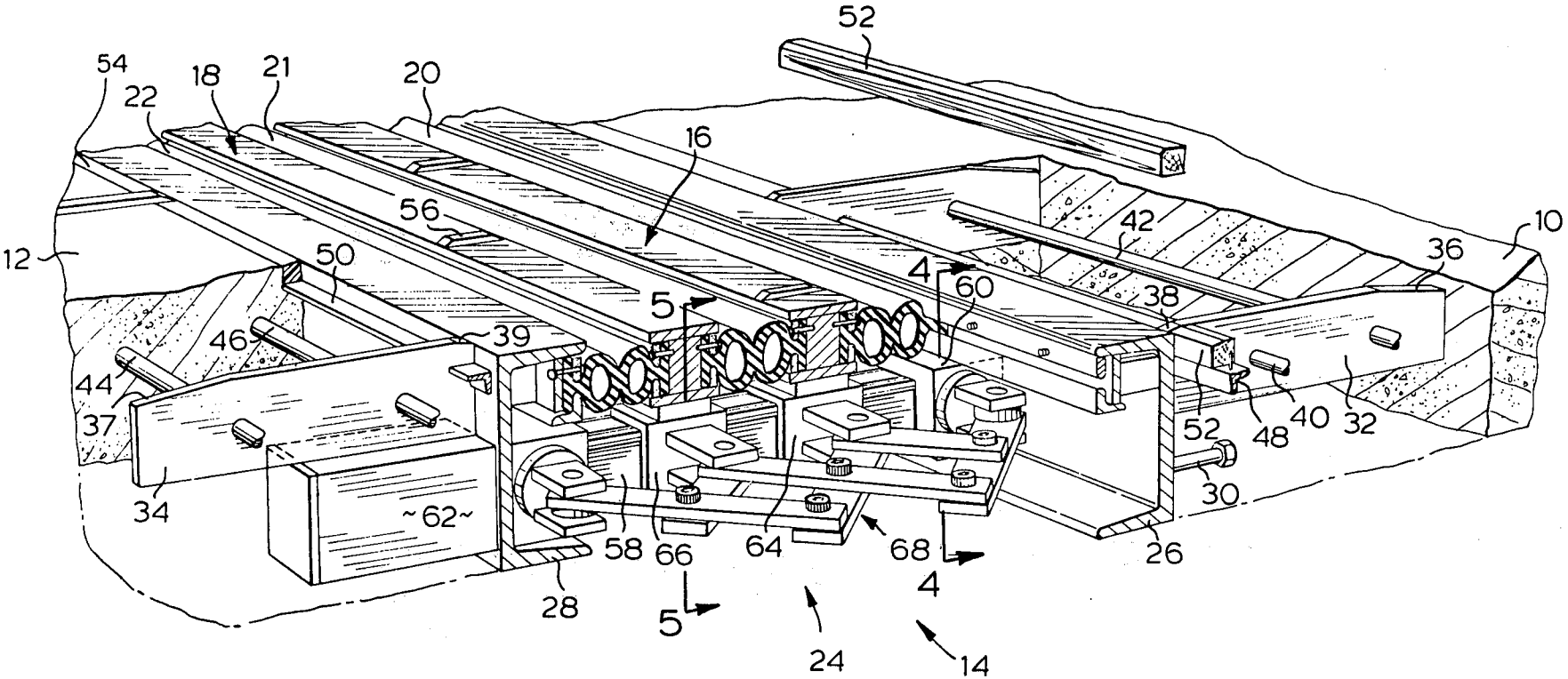
FIG. 2 is a perspective view from slightly above the roadway, and partly in section, of details of the assembled joint, looking generally in a direction across the roadway, i.e. down the length of the gap between adjacent roadway sections.

The overall structure and arrangement of a joint unit 24 is illustrated in FIG. 2. The concrete roadway sections 10, 12 are each provided along their edges with a respective channel beam 26, 28, the channel of which faces into the gap 14. The channel beams are rigidly secured to the concrete by integral Nelson studs such as 30, in the conventional way. Each of the channel beams 26, 28 is provided with a series of vertical anchoring plates such as 32, 34 respectively, welded to the outer face of the channel beams 26, 28 and extending away from the gap 14. The top surfaces of the plates 32, 34, in the finished joint, form part of the roadway surface. At their rearward ends, away from the gap 14, they are provided with inclined top surfaces 36, 37 sloping upwardly in the direction towards gap 14, so as to accommodate the traverse of a snowplow or similar blade without dislodgement of the roadway section. Similar top surface inclinations 38, 39 are provided extending away from the gap 14, at the front of the plates, for the same purpose. Adjacent pairs of vertical plates 32, 34 are tied together for rigidity purposes by transverse bars 40, 42, 44, 46 welded to the plates.

Also extending between adjacent pairs of plates 32, 34 etc. are angle irons 48, 50, the vertical faces of which are welded to the external vertical face of the respective channel beams 26, 28 to present a horizontal surface a short distance below the top edge of channel beams 26, 28. The angle irons 48, 50 are welded at their ends to the plates 32, etc. When the joint is assembled ready for installation and pouring of concrete, wooden struts 52 are ledged on the upper horizontal surface of the channel beams 26, 28, the wooden struts 52 being of a suitable length to extend tightly between pairs of plates 32, etc., and of a suitable thickness to register with the top surfaces of the plates 32. The concrete roadbed 10, 12 is poured, substantially to the level of the inclined surfaces 36, 37 on the plates 32, 34. After the concrete has set and hardened, the wooden struts 52 can be removed, leaving a short gap or recess in the poured concrete, extending between the plates 32, 34. This gap can subsequently be filled with epoxy resin as indicated at 54. Such an arrangement and procedure offers substantial advantages, since it is well known that concrete and steel will not properly bond together to give a watertight joint. However, epoxy resin will bond firmly both to steel and to concrete, so that in this manner, a watertight joint as between the channel beams 26, 28 and the plates 32, 34 welded thereto, on one hand, and the concrete of the roadbeds 10, 12, on the other, is obtained.

At intervals of about 3 feet along their lengths, the intermediate beams 16, 18 are provided on their top surfaces with skid bars 56, having upwardly and inwardly inclined side surfaces. The skid bars 56 are presented in staggered relationship with those on the adjacent intermediate bar. The provision of these skid bars serves to prevent damaging and digging out of the joint unit 24, by traverse of a snowplow, grader or other bladed vehicles across the expansion joint.

The joint unit itself, generally indicated 24, comprises a spanning member 58 extending across the width of the gap 14, the ends of the spanning member 58 being slidably received in respective end boxes 60, 62, protruding through apertures in the channel beams 26, 28. The spanning member also passes slidably through glide boxes 64, 66, respectively secured to intermediate beams 16, 18. The end boxes 60, 62 and glide boxes 64, 66 have a pivotal lazy tongs link arrangement 68 pivotally secured thereto and extending to one side of the boxes and spanning member 58. The spanning member 58 and lazy tong link arrangement 68 are hingedly mounted into the end boxes 60, 62 to accommodate relative vertical movement as between roadway sections 10, 12. The intermediate beams 16, 18 with sealing strips 20, 21, 22 mounted therebetween are located vertically above the spanning member 58.

Figure 3:
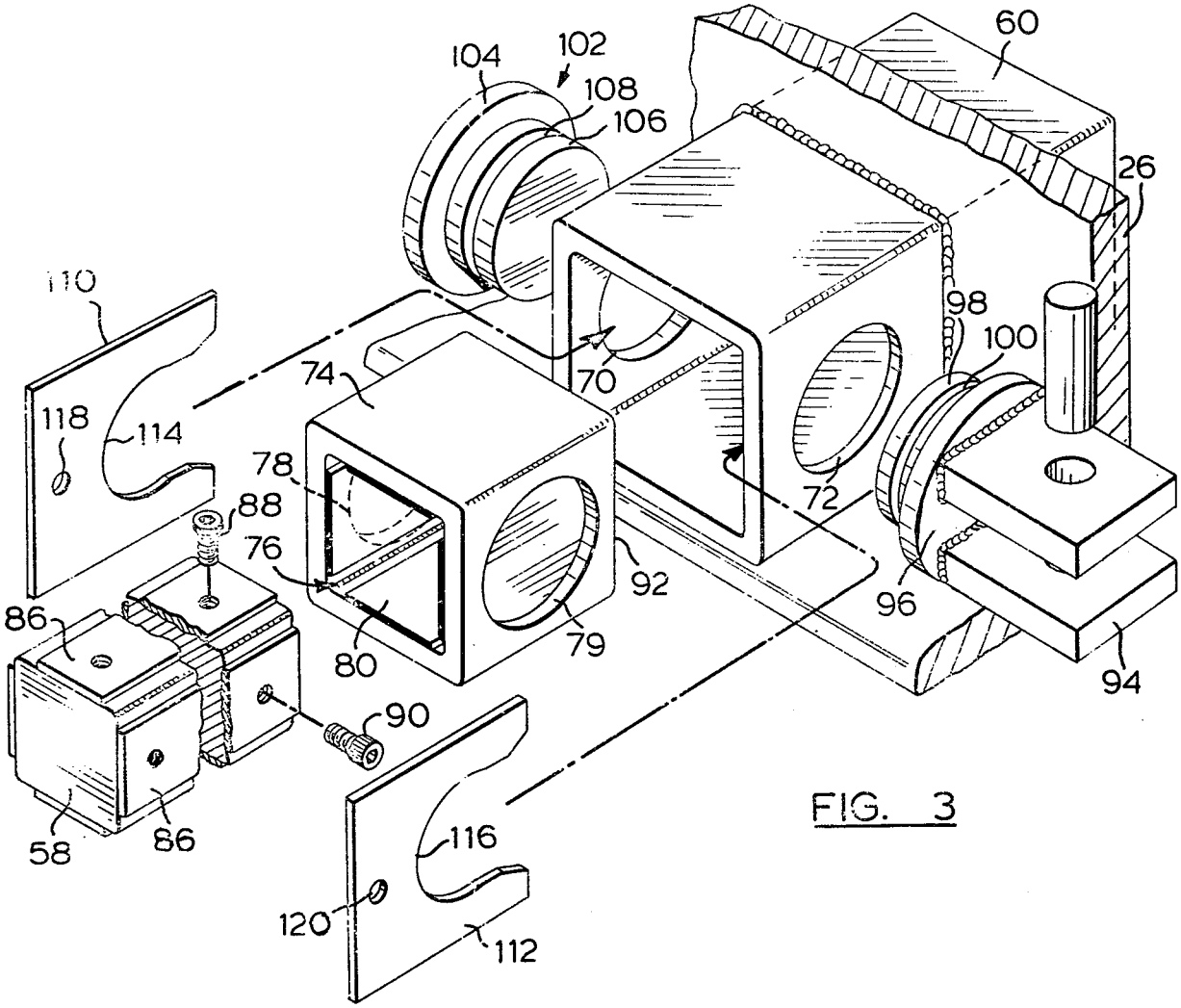
FIG. 3 is an exploded perspective view of the end box structure of one unit of the joint shown in FIG. 2.
Figure 4:
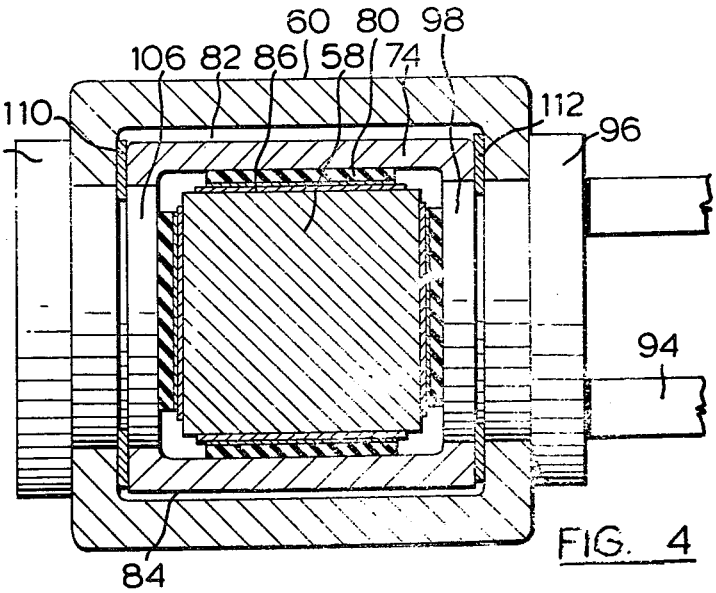
FIG. 4 is a vertical cross-sectional view, along the line 4—4 of FIG. 2, i.e. through an assembled end box structure and viewing towards the adjacent roadway section, but omitting parts above and below the box.

With reference to FIG. 3, this illustrates in exploded perspective the manner in which the spanning member 58 and lazy tong link arrangement 24 are mounted in the concrete roadway section. The end box 60 extends through an aperture in and is welded to the channel beam 26, so that it is rigidly fixed thereto. The end box 60 is of generally square cross-section, with a square aperture therein, facing inwardly towards the gap between the roadway sections. In its forward side walls, located forwardly of the vertical web of channel beam 26, the end box is provided with a pair of aligned circular apertures 70, 72. An intermediate cubiform box 74 is provided, having a square aperture 76 extending right way through its center, from its front wall to its rear wall, and having a pair of aligned circular apertures 78, 79 in its side walls. All four of the interior side walls of the intermediate cubiform box 74 are provided with glide pads 80, these pads comprising a reinforced rubber body with a friction-reducing PTFE coating. The intermediate cubiform box 74 is a loose fit in the square aperture in the end box 60, in which it is placed so that its circular side wall apertures 78, 79 align with the similar sized circular apertures 70, 72 in the end box 60. As shown in FIG. 4, when the intermediate cubiform box 74 is located in its correct position inside the end of end box 60, space 82 is left between the top of box 74 and the inner top wall of end box 60, and space 84 is left between the bottom of box 74 and the bottom inner surface of end box 60. Intermediate box 74 can, therefore, move angularly with respect to end box 60 to a limited degree, and therefore with respect to channel beam 26, if necessary.

The spanning member 58 is a solid steel bar, of generally square cross-section, having secured to its four longitudinal surfaces stainless steel surface plates 86. The surface plates 86 are secured to the spanning member 58 by means of screws 88, 90. The screws 88 which are received in apertures in the top and bottom surfaces of the spanning member 58 are flat headed screws, so as to be received substantially flush with the stainless steel surface. The screws 90 which are received in screw threaded apertures in the side surfaces of the spanning member 58 have large, protruding heads. The spanning member 58 is a close sliding fit within the aperture 76 of the intermediate cubiform box 74, and in fact on assembly extends right the way through the cubiform intermediate box 74. The protrusion of the large heads on the side screws 90 act as stop members, preventing the withdrawal of the spanning member 58 through the intermediate cubiform box 74, by engagement of the head of screws 90 against the rear wall 92 of the intermediate cubiform box 74.

The forks 94 of the lazy tong link arrangement 68, which are to be secured to the channel beam 26, are welded to a circular plate 96, said plate having a cylindrical protrusion 98, of smaller diameter than the plate 96, and extending away from the direction of forks 94. A circumferential groove 100 is provided in the cylindrical protrusion 98. The protrusion 98 is a close fit in the aperture 72 in the side wall of the end box 60, for hinging movement therein. The circumferential groove 100 is positioned axially, so that it is inside the box 60 and aligned with the space between box 60 and intermediate cubiform box 74, when the parts are assembled. The end of cylindrical protrusion 98 extends into and is a close fit in the circular aperture 79 in the side wall of the intermediate cubiform box, for hinging purposes.

At the other side of the end box 60, there is provided a circular plug like element 102 having an outer, larger circular flange 104 and an inwardly extending smaller cylindrical protrusion 106, which fits closely into circular aperture 70 of end box 60 and circular aperture 78 of intermediate cubiform box 74, for hinging purposes in a similar way. A circumferential groove 108 is provided on cylindrical protrusion 106, said groove 108 aligning in the space left between the end box 60 and the intermediate box 74.

A pair of clamping elements 110, 112 are provided, one at each side, and each in the form of a metal plate having a part circular recess 114, 116 respectively therein. The recesses 114, 116 form more than half a circle, the diameter of the circle closely corresponding to that of the respective circular grooves 108, 100. Each clamping member 110, 112 is provided with a small gripping aperture 118, 120, located forwardly of the recesses 114, 116.

On assembling the end structure, therefore, firstly the intermediate cubiform box 74 is slid over the end of the spanning member 58, until the spanning member 58 protrudes beyond the end of 92 of the cubiform box. Then screws 90 are applied, to fasten the side stainless steel plates 86 to the spanning member side surfaces in a rigid manner, and to provide stop members in the form of the screw heads, to prevent withdrawal of the spanning member through the intermediate cubiform box 74. Next, this assembly is inserted into the square aperture in the end box 60, until the circular aperture 78 in the side walls of the cubiform box 74 are aligned with the apertures 70, 72 in the side walls of the end box 60. Then the plug like cylindrical member 102 is inserted through aperture 70 at one side of the end box 60, until the flange 104 abuts against the side of the box 60, and similarly the cylindrical protrusion 98 is inserted through aperture 72 in the side wall of the end box 60. Next, the clamping elements 110, 112 are driven into position between the intermediate box 74 and the end box 60, until their part circular recesses 114, 116 respectively engage circumferential grooves 108, 100, thereby preventing withdrawal of the plug member 104 and the cylindrical protrusion 98 on the forks 94 axially from engagement with the box 60. The end box arrangement is now assembled as shown in the sectional view, FIG. 4.

It will be appreciated that, in this arrangement, spanning member 58 is slidable with respect to the structure, with sliding engagement of stainless steel plates 86 on the spanning member 58 with anti-friction PTFE glide pads in the intermediate box 74. This sliding motion is useful in accommodating thermal expansion and contraction of the gap. Moreover, in the event that the channel beam 26 moves upwardly or downwardly with respect to the channel beam at the other side of the gap, e.g. due to settlement of the bridge supports, the spanning member 58 and the forks 94 of the lazy tong link arrangement 68 can hinge to accommodate such vertical misalignment, due to the space left between the intermediate box 74 and the end box 60, and the pivotal arrangements previously described.

The end box 62, which passes through an aperture in channel beam 28 and into the other roadway section 12 is, in all essential respects, the same as end box 60, and the structural arrangements for fitting the end of spanning member 58 into end box 62, for limited up and down hinging movement of the spanning member 68 and the lazy tongs arrangement 24 relative to the roadway section is the same, so that it does not need separate description.

Figure 5:
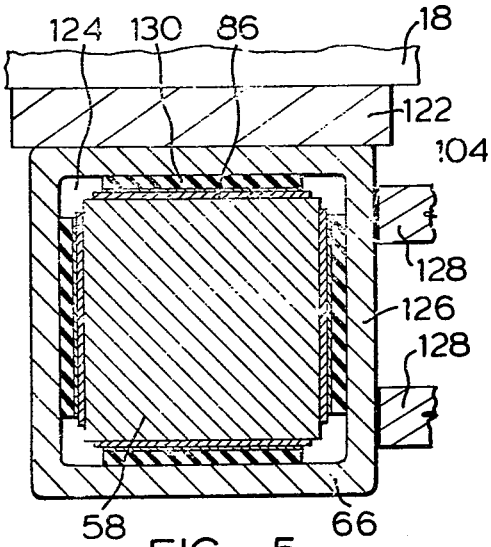
FIG. 5 is a vertical cross-sectional view, along the line 5—5 of FIG. 2, i.e. through an assembled glide box structure.

FIG. 5 shows in section the arrangement of a glider box or unit 64 in the assembled joint unit. To the underside of the intermediate beam 16, which has a generally I-shaped cross-section, there is secured as by welding a seat 122 in the form of a metal plate. The glider box 66 is secured as by welding to the underside of the seat 122. The glider box 66 has a generally square section aperture 124 extending therethrough, in a direction transversely across the gap 14. Fixedly secured as by welding to a side wall 126 of glider box 66 and extending outwardly therefrom are forks 128 for pivotal connection to an intermediate part of the lazy tongs link arrangement 24. Glide pads 130, having reinforced rubber base parts and PTFE anti-friction surfaces, line the four interior side walls of the glide box 66, and the spanning member 58 is a close sliding fit therebetween, with its stainless steel surface plates slidably bearing against the glide pads 130. The glide box 64 associated with intermediate beam 16 is similar in all respects to glide box 66, having the spanning member 58 passing therethrough in easily slidable manner.

Figure 6:
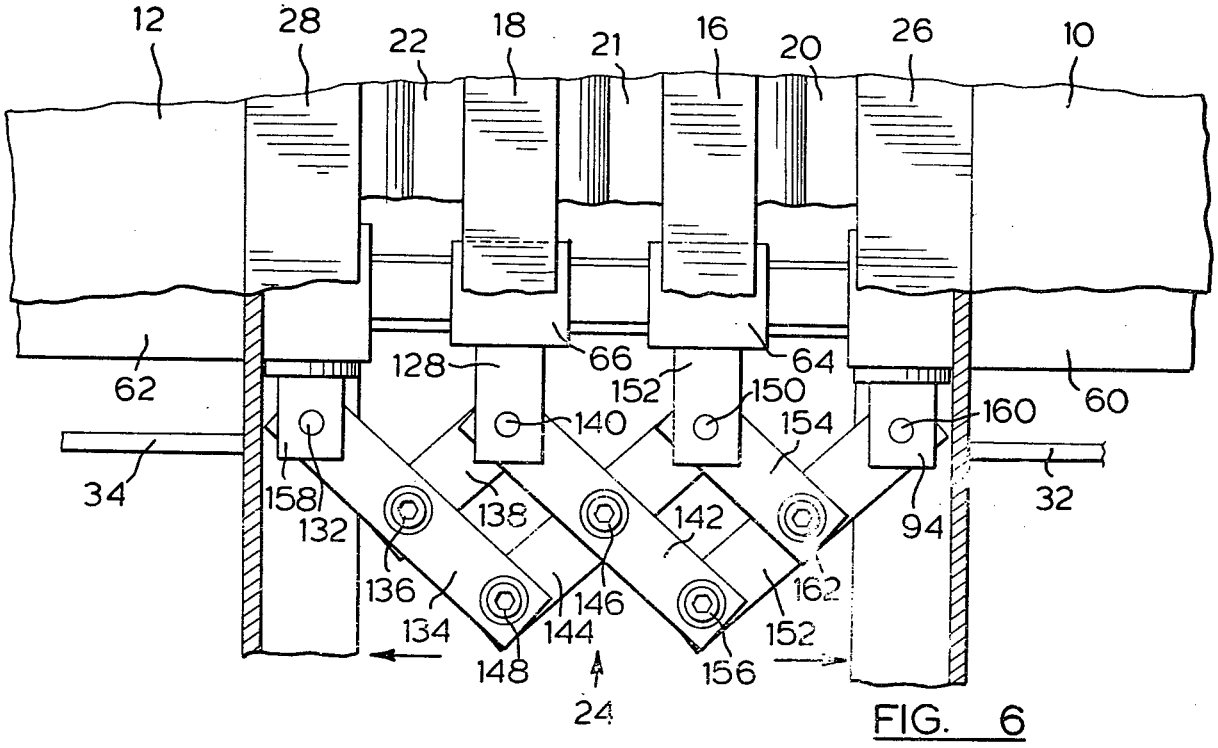
FIG. 6 is a plan view, partly in section, showing a joint unit according to the invention in its expanded position.
Figure 7:
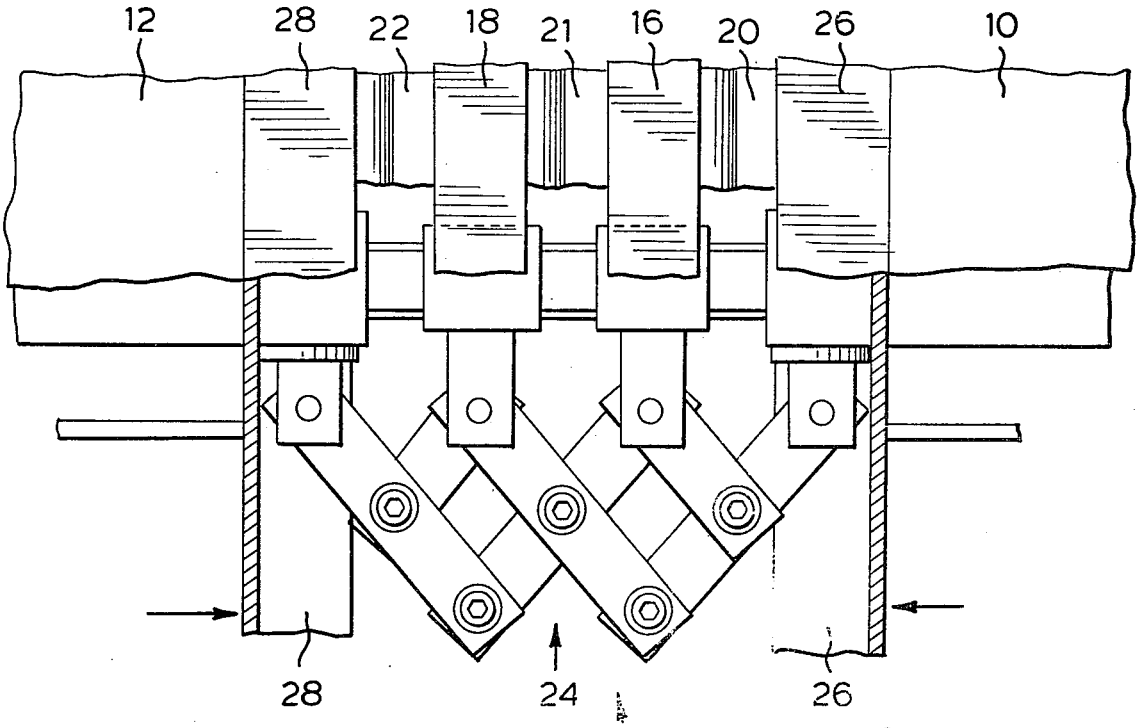
FIG. 7 is a view similar to that of FIG. 6, showing the joint unit in a contracted position.

The operation of the joint units will be apparent from FIGS. 6 and 7, in conjunction with the above description. FIG. 6 generally shows a part of the joint unit, in plan view, in its expanded condition. The forks 94 extending from the end box 60 are pivotally connected by means of a pivot pin 160 to a first link arm 152 of the lazy tongs arrangement 24. Near its center, first link arm 152 is pivotally connected to a pivot pin 162 to the end of a second link arm 154 of the lazy tongs arrangement. The other end of this second link arm 154 is pivotally connected by means of a pivot pin 150 to the forks 152 fixed to the glide unit 64 which is secured to the intermediate beam member 16. The end of a third link arm 144 of the lazy tongs link arrangement 24 is also pivotally connected to pivot pin 150. A fourth link arm 142 is pivotally connected at its center, by means of pivot pin 146 to the center of third link arm 144, at one of its ends by means of pivot pin 156 to the end of first link arm 152 and at its other end by means of pivot pin 140 to the forks 128 welded to glide unit 66 which is fixed to the other intermediate beam member 18. A fifth link arm 134 and a sixth link arm 138 are provided to complete the lazy tongs link arrangement 24, the fifth link arm 134 being pivotally connected by pivot pin 148 to the end of third link arm 144 remote from its connection to the forks 152. The other end of the fifth link arm 134 is pivotally connected to the forks 158 extending from the other end box 62, by means of pivot pin 132. The sixth link arm is pivotally connected to pivot pin 140, associated with forks 128 of the glide unit 66, at one end, and is pivotally connected by means of pivot pin 136 to the middle of fifth link arm 134.

Now, in this arrangement, the ratio of the spacings between roadway section 10 and intermediate beam member 16, between intermediate beam members 16, 18, and between intermediate beam member 18 and roadway section 12, are maintained in a constant ratio, even when the overall size of the gap 14 between the roadway sections changes due to thermal factors. In FIG. 7, it will be seen that roadway section 10 has expanded, thereby pushing channel beam 26 to the left, narrowing the gap 14. The lazy tongs link arrangement responds to this movement, and contracts, by pivoting action, to move the intermediate beams 16, 18 to the right, a proportionate distance, to maintain the same ratio of spacing within the overall gap. This movement of intermediate beams 16, 18 and channel beam 26 is accommodated by sliding movement of the spanning member 58 within the glide units or boxes 64, 66, and within the end boxes 60, 62 as previously described. By this means, the change in overall width of the gap is accommodated equally by the various resilient sealing strips 20, 21, 22, located in the gaps, and there is no risk of one of these strips becoming over extended as a result of such gap movement, to spoil its efficiency.

Further, if either of the roadway sections 10, 12 should become vertically displaced with reference to the other, e.g. by the slight sinking of a bridge pillion supporting one of the roadway sections, this movement can be accommodated without damage to the lazy tongs link arrangement 24, by the arrangement of spanning member 58 within end boxes 60, 62 as previously described. If this vertical displacement occurs, spanning member 58 will assume a downward inclination across the gap, to accommodate it, hinging within the end boxes 60, 62. As it does so, it will bring the intermediate beam members 16, 18 down also, a proportionate amount, by engagement of the undersurface of the intermediate beam member 58 with the bottom walls of the glide boxes 64, 66, thereby evening the height discrepancy across the roadway joint. The lazy tongs link arrangement 24 will also assume the same downward inclination across the gap, since rotation of the forks 94, 158 thereof relative to the end boxes 60, 62 is permitted as previously described with reference to FIGS. 3 and 4, so that the lazy tongs link arrangement can continue to operate to equalize the change in width of the gap without bending, jamming the pivot pins or otherwise damaging the lazy tongs arrangement.

Figure 8:
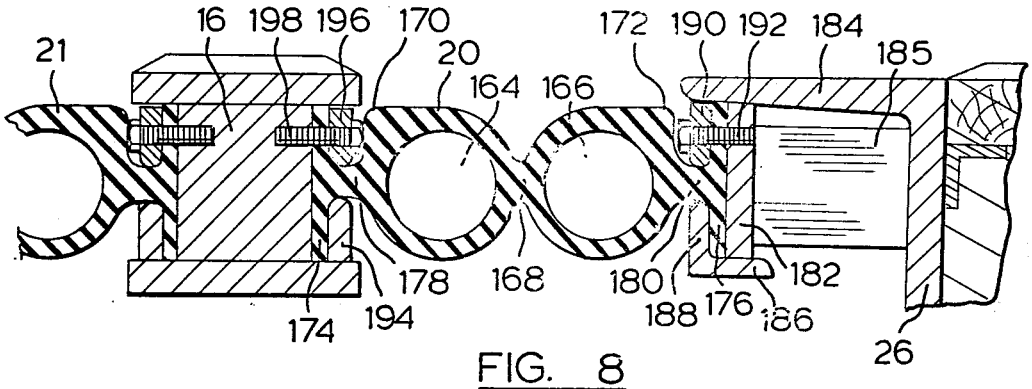
FIG. 8 is a vertical section of a portion of the joint showing the sealing strip, in its expanded position.
Figure 9:
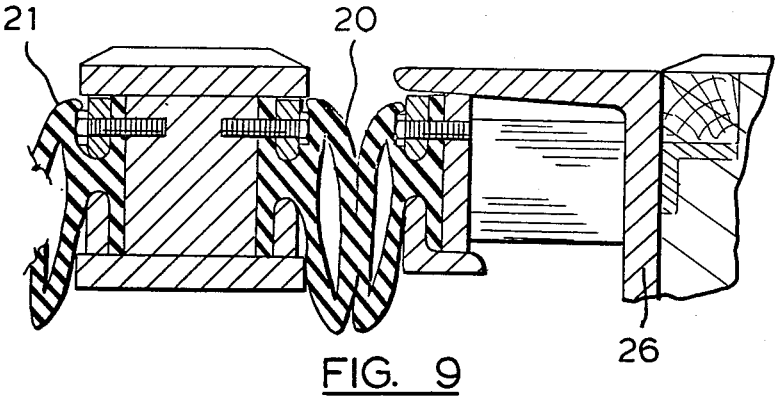
FIG. 9 is a view similar to that of FIG. 8, showing the parts in the contracted positon.

FIGS. 8 and 9 illustrate a specific preferred embodiment of the form of sealing strip for use in the present invention, its means of anchoring in the spaces in the expansion joint units, and its action on expansion and contraction of the gap.

With reference to FIG. 8, the sealing strip 20 as viewed in cross-section comprises a pair of single circular apertures 164, 166 surrounded by a rubber web, the web having a narrow neck 168 between the two apertures 164, 166. The top wall of the strip 20 terminates at its sides in a pair of shoulders 170, 172. Side mounting flanges 174, 176 are provided outwardly of the shoulders 170, 172, the flanges 174, 176 being integrally connected to the rest of the sealing strip by means of side necks 178, 180. It will be noted that the side flanges 174, 176 extend upwardly beyond the level of the side necks 178, 180, approximately to the level of the shoulders 170, 172. This arrangement has significant practical advantages, in enhancing the sealing action of the sealing strip 20, since it is virtually impossible for water to seep around the seal at the edges, over shoulder 170, with this arrangement, the side flanges acting in the manner of a dam. It also enables the sealing strips to be removed from above the joint, the replacement purposes, in conjunction with the mounting arrangements described below.

For mounting the sealing strips 20, etc. the channel beam 26 is provided with a vertical flange member 182, welded to and depending from the underside of the top 184 of the channel member 26. The vertical flange member 182 depends a distance of about $\frac{1}{3}$ of the vertical width of the channel of member 26, which approximately corresponds to the height of the side flange 176 of the sealing strip 20. The vertical flange member 182 extends the full length of the channel member 26, and is also anchored thereto by means of webs 185 provided at intervals along the length of the channel member 26 and welded to the internal vertical face of the channel member 26 and the rear vertical face of the flange 182. Fixed to the bottom edge of the vertical flange 182, and extending the full length thereof, is an angle bar 186 having an upstanding portion 188 extending upwardly from the bottom of the flange member 182 and spaced inwardly a short distance therefrom. A depending bar 190 extends downwardly from the end of the top 184 of channel member 26, in alignment with the upstanding part 188 of the angle bar 186, leaving a space therebetween sufficient to tightly accommodate the side neck 180 of the sealing strip 20. Aligned bolt holes for the accommodation of bolts 192 are provided at intervals, through the depending member 190 and the vertical flange member 182, the bolts being held rigidly in vertical flange member 182, to prevent rotation and facilitate the tightening of nuts thereon.

An essentially similar mounting arrangement is provided on the side face of the intermediate beam member 16, for receiving the other side mounting flange 174 of the sealing strip 20. Thus a vertical strip 194 is welded to and is upstanding from the bottom web of the I-beam intermediate member 16. A vertical depending bar 196 is bolted to and depends from the top web of the I-beam 16, in substantial vertical alignment with the upstanding bar 194. Bolts 198 are provided at intervals along the length of the depending bar 196, and suitable bolt apertures are provided in the depending bar 196, in alignment with blind apertures in the body of the I-beam 16, for reception of these bolts, to fasten the bar 196 and sealing strip in position. The gap left between upstanding bar 194 and depending bar 196 is sufficient tightly to receive the side neck 178 of the sealing strip. The side mounting flange 174 of the sealing strip 20 is snugly received in the gap left between the body of the I-beam 16 and the inner side faces of the members 194, 196.

It will thus be appreciated that it is a simple matter to remove and replace the seal 20, when necessary. The seal is sufficiently flexible, that the shoulders 170, 172 can be pushed inwardly and downwardly without difficulty, thereby giving access to bolts 198, 192 respectively, for their disconnection. Once the bolts have been disconnected, the bars 190, 196 can also be removed and the seal can be withdrawn. A new seal can then be fitted, by means of its mounting flanges 174, 176, with the bolts 198, 192 extending through the aligned bolt holes and extending through the mounting flanges of the seal, and bars 190, 196 are replaced into position as shown in FIG. 8. The seal is nevertheless effective, because of its design and construction, in substantially totally preventing water from seeping around its sides. The arrangement of shoulders 170, 172, along with narrow side necks 178, 180 and mounting flanges extending vertically from the side necks, effectively prevents this seeping of water.

When the roadway sections expand and the gap between them consequently contracts, the sealing strip 20 takes up the general configuration shown in FIG. 9, with substantially all of the necessary compression being taken up by deformation of the circular apertures 164, 166. The resilient rubber web of the sealing strip thus does not operate in either tension or compression to any significant extent, but is always in its substantially relaxed condition over its major body portion, with the exception of sealing engagements with the various web formations. The useful lifetime of the resilient seal is greatly enhanced by this arrangement, whereby it always operates in its relaxed condition over its major body parts.

Whilst the invention has been specifically described with reference to a specific preferred embodiment showing the presence of two intermediate beam members, it will be readily appreciated that it is not limited thereto. It is a simple matter to modify the arrangement according to the invention to accommodate as many modular sections as are required so as properly and conveniently to fill the gap and provide for the necessary degree of expansion, as few as one and as many as twelve or even more intermediate members such as 16 can be provided, dividing the gap between the roadway sections into various individual gaps. The lazy tongs link arrangement 24 can readily be modified so as to accommodate such larger numbers of intermediate beams. It is, however, preferred that, when the number of intermediate beams exceeds four, a double lazy tongs arrangement be provided, and a double unit be correspondingly provided in each joint unit, including pairs of end boxes 60 and 62 at each side, a pair of substantially aligned spanning members 58 be provided, and all of the intermediate beam members be provided with pairs of glide boxes to accommodate each spanning member in the joint unit, and similarly associated with the other side of the lazy tongs arrangement. This provides the additional strength and rigidity which is needed to cope with expansion joints of this size and complexity.

It will be readily appreciated that other modifications and embodiments of the invention can be used without departing from the spirit and scope of the invention, which is solely defined by the accompanying claims.

What I claim is:

1. An expansion joint for adjacent first and second roadway sections having a gap therebetween to allow expansion of said sections, the joint comprising:

at least one intermediate beam member in said gap and extending along at least a substantial portion of the width of the roadway sections;

resilient sealing means located in and closing gaps between said intermediate beam member and the roadway sections, substantially to seal the roadway surface across the gap;

a plurality of joint units in spaced apart relationship across the width of the roadway sections, each said joint unit extending from the first roadway section to the second roadway section across the gap, and including:

a spanning member extending from the first roadway section to the second roadway section and movable with respect to at least one of said roadway sections;

each said joint unit further including a glider box, fixedly secured to the intermediate beam member, the spanning member passing through said glider box in sliding relation thereto so as to support the intermediate beam member on the spanning member for relative movement therebetween;

each joint unit further including means for substantially maintaining a predetermined ratio of distance between the first roadway section edge and the intermediate beam member, to that between the second roadway section edge and the intermediate beam member, when the size of the gap between the first and second roadway sections changes, said means comprising:

a sectionally expandable and contractable device secured to the first roadway section, the intermediate beam member and the second roadway section, said device having expandable and contractable sections between said securings which expand and contract in the direction across the gap, the expansion or contraction of one of said device sections causing corresponding expansion or contraction of the others of said device sections, in predetermined relationship thereto, so as to move the intermediate beam member transversely across said gap in response to movement of the first roadway section or second roadway section to vary the size of said gap.

2. The expansion joint of claim 1 wherein the sectionally expandable and contractable device comprises a lazy tongs link arrangement pivotally secured to the first roadway section and pivotally secured to the intermediate beam member.

3. The expansion joint of claim 1 wherein said glider box is pivotally secured to an intermediate section of the lazy tongs link arrangement.

4. The expansion joint of claim 3 wherein each of said joint units further includes a pair of end boxes protruding into the respective roadway sections and fixed with respect thereto, the pair of end boxes being in substantial transverse alignment across said gap, the ends of the spanning member being slidably received in said end boxes.

5. The expansion joint of claim 4 wherein said end boxes are pivotally secured to the ends of the lazy tongs link arrangement, to provide the pivotal securing thereof to the respective roadway sections.

6. The expansion joint of claim 5 wherein the spanning member and the lazy tongs link arrangement are mounted in said end boxes for limited angular movement relative thereto in a vertical plane.

7. The expansion joint of claim 6 wherein each of said end boxes has an intermediate collar-like member received therein, with heading space provided between the collar-like member and the top box, the spanning member being received as a close sliding fit inside said collar-like member, and said heading space providing for limited relative angular movement between the spanning member and the end box in a vertical plane.

8. The expansion joint of claim 6 wherein the end boxes have circularly apertured side walls, and the lazy tong link arrangement has a cylindrical protrusion received as a close fit in said circularly apertured side walls, for angular movement relative thereto in a vertical plane.

9. The expansion joint of claim 3 including from 2 to 10 intermediate beam members, arranged mutually parallel to one another in said gap, each intermediate beam member having fixedly secured thereto in the vicinity of each of said joint units a respective glider box, each glider box being secured to the respective lazy tongs link arrangement of said joint unit.

10. The expansion joint of claim 9 wherein the glider boxes are provided with anti-friction liners on the internal walls thereof, for smooth sliding engagement of the spanning member passing therethrough.

11. The expansion joint of claim 9 wherein the intermediate beam members have upper surfaces constituting part of the roadway surface, said upper surfaces being provided at intervals along their lengths with short upstanding skid bars, said skid bars having shallow upwardly inclined top faces.

12. The expansion joint of claim 9 wherein the intermediate beam members are generally I-shaped in cross-section, and the resilient sealing members are releasably clamped against the side faces of the intermediate beam members.

13. The expansion joint of the claim 12 wherein the resilient sealing means, as viewed in cross-section, has side mounting flanges, and the side faces of the intermediate beam members are provided with longitudinally extending formations depending from the head of the I-shape to form an inverted channel thereon, the side mounting flanges of the resilient sealing means being received in said inverted channel.

14. The expansion joint of claim 13 wherein the longitudinally extending depending formations are releasable, and including releasable clamping bolts extending through said depending formations, through the resilient sealing means and into the main body of the intermediate beam member, at intervals along the position thereof, for releasably retaining the sealing strip and the depending formations in position.

15. The expansion joint of claim 2 wherein the edges of the first and second roadway sections defining said gap are provided with beams secured to and extending along the length of said edges, the spanning member passing slidably through apertures in the beams.

16. The expansion joint of claim 15 wherein said beams are provided at intervals along their lengths with anchoring plates, said anchoring plates being fixedly secured to the beams and extending in a direction away from the gap, in a generally vertical plane, and embedded in the concrete roadway sections.

17. The expansion joint of claim 16 wherein the upper surfaces of said plates constitute upper roadway surface, and are provided with inclined portions, said inclined portions slopping gradually upwardly in the direction towards the gap.

18. The expansion joint of claim 15 wherein the edge beams are substantially sealed to the concrete of the roadway sections, at least at their uppermost portions, through the intermediary of an epoxy resin strip.

* * * * *